US005638777A

United States Patent [19]

Van Avermaete

[11] Patent Number: 5,638,777

[45] Date of Patent: Jun. 17, 1997

[54] COMPRESSION OR SPARK IGNITION FOUR-STROKE INTERNAL COMBUSTION ENGINES HAVING A VARIABLE COMPRESSION RATIO ENABLING HIGH SUPERCHARGING PRESSURE LEVELS

[76] Inventor: Gilbert L. Ch. H. L. Van Avermaete, 2A, rue de Zoufftgen, L-3333 Hellange, Luxembourg

[21] Appl. No.: 525,554

[22] PCT Filed: Mar. 21, 1994

[86] PCT No.: PCT/LU94/00001

§ 371 Date: Sep. 19, 1995

§ 102(e) Date: Sep. 19, 1995

[87] PCT Pub. No.: WO94/21905

PCT Pub. Date: Sep. 29, 1994

[30] Foreign Application Priority Data

Mar. 19, 1993 [LU] Luxembourg ..... 88235

[51] Int. Cl.[6] ..... F02B 25/08

[52] U.S. Cl. ..... 123/52.4; 123/70 R

[58] Field of Search ..... 123/51 A, 51 AA, 123/51 BA, 52.4, 52.7, 70 R, 70 V

[56] References Cited

U.S. PATENT DOCUMENTS

| | | | |
|---|---|---|---|
| 1,731,590 | 10/1929 | Roche | 123/518 |
| 2,551,478 | 5/1951 | Wagers | 123/73 A |
| 3,446,192 | 5/1969 | Woodward | 123/51 A |
| 3,570,459 | 3/1971 | Combs | 123/51 BA |
| 3,675,630 | 7/1972 | Stratton | 123/70 R |
| 3,961,607 | 6/1976 | Brems | 123/78 R |
| 4,211,082 | 7/1980 | Bristol | 123/70 R |
| 4,781,155 | 11/1988 | Brucker | 123/70 V |
| 4,860,701 | 8/1989 | Jackson | 123/51 A |

FOREIGN PATENT DOCUMENTS

| | | |
|---|---|---|
| 0026592 | 4/1991 | European Pat. Off. . |
| WO9106751 | 5/1991 | WIPO . |

*Primary Examiner*—David A. Okonsky

*Attorney, Agent, or Firm*—Sughrue, Mion, Zinn, Macpeak & Seas

[57] ABSTRACT

An engine including an assembly of at least two cylinders with different displacements and two crankshafts coupled at the same rotational speed via a gear train and a variably timed transmission having three concentric shafts separable from the drive assembly and designed to reduce the compression ratio as the intake pressure increases. The maximum and minimum compression ratios are set within the angular displacement limits between the two cylinders, and between said two cylinders and the clearance space, so that (a) the start of the variably time transmission stroke increases the translation of the piston by units of angular displacement between the two crankshafts at the end of compression phase, and (b) the end of the variably time transmission stroke combines combustion gas expansion on the piston at least from the maximum torque on the crank of the short-stroke crankshaft.

8 Claims, 6 Drawing Sheets

| | CRANKSHAFT | CONNECTING ROD | DIAMETER | CUBIC CAPACITY |
|---|---|---|---|---|
| SMALL PISTON | 0.055 | 0.235 | 0.105 | 0.000952492 |
| LARGE PISTON | 0.097 | 0.34 | 0.17 | 0.004403413 |
| CLEAR VOL. | | | | 0.0002 |

| LEAD ANGLE | MIN.CUBIC CAPACITY | MAX.CUBIC CAPACITY | VOLUMETRIC RATIO |
|---|---|---|---|
| 0 | 0.0002 | 0.0055559 | 27.7795243 |
| 36 | 0.0002932 | 0.0054974 | 18.74992 |
| 69 | 0.00051497 | 0.00534379 | 10.37671655 |

| | CRANKSHAFT | CONNECTING ROD | DIAMETER | CUBIC CAPACITY |
|---|---|---|---|---|
| SMALL PISTON | 0.07 | 0.28 | 0.125 | 0.001718058 |
| LARGE PISTON | 0.096 | 0.35 | 0.17 | 0.004358017 |
| CLEAR VOL. | | | | 0.00023 |

| LEAD ANGLE | MIN. CUBIC CAPACITY | MAX. CUBIC CAPACITY | VOLUMETRIC RATIO |
|---|---|---|---|
| 0 | 0.00023 | 0.00630608 | 27.7795243 |
| 30 | 0.000335 | 0.00624333 | 18.63679643 |
| 70 | 0.000762 | 0.00596644 | 7.829961 56 |

COMPRESSION OR SPARK IGNITION FOUR-STROKE INTERNAL COMBUSTION ENGINES HAVING A VARIABLE COMPRESSION RATIO ENABLING HIGH SUPERCHARGING PRESSURE LEVELS

THE PRIOR ART

The supercharging principle of piston engines consists in increasing the air masses without increasing the displacement. For constant compression ratio engines, this results in an increase of the combustion pressure and a higher specific output (with reference to the cylinder volume in liters). However, when the supercharging pressure is increased, the mechanical and thermal stresses increase on the engine members. This main drawback is due to the fact that the compression ratio generated by the combustion chamber and the piston stroke cannot be altered and adapted to pressure and temperature variations of the intake air and to variations in engine speeds and temperatures.

Consequently, engine manufacturers respect certain construction rules by defining, on the one hand, a limit to the amplitude of intake pressure variations and, on the other hand, by achieving an average compression ratio between the atmospheric intake pressure and the supercharging pressure. Since the fact of defining an average compression ratio is a comprise which conciliates at best the different engine loads and speeds, the pressures and temperatures of the atmospheric intake are too low and the supercharging pressures and temperatures are too high.

BRIEF DESCRIPTION OF THE INVENTION

This invention relates to the concept of an engine having a variable compression ratio, which consists in varying the volume of the combustion chamber in function of the intake air density and temperature, the engine speed and the engine temperature, in order to produce a hypersupercharging effect on the engine by means of a single or double supercharging pressure with intercooling.

According to the invention, this new engine has two crankshafts, one with a long-stroke crank and the other with a short-stroke crank. Both crankshafts are coupled at the same rotational speed via a gear train and a variably timed transmission, the coupling gear of which is part of the gear train and may be shifted at an angle with respect to the short-stroke crankshaft, in order to provide an infinite number of lead angles between the two crankshafts without interrupting the coupling of the latter.

According to the invention, the variably timed transmission is designed so that it may be removed from the engine independently of the short-stroke crankshaft, which offers the advantage of easy and fast replacements of defective parts or permits a standard exchange of the variably timed transmission. The cylinders, having different displacements, are respectively arranged above one of the two crankshafts. The crank of the short-stroke crankshaft coacts with the connecting rod of the piston in the smaller cylinder and the crank of the long-stroke crankshaft coacts with the connecting rod of the piston in the larger cylinder. The two cylinders are connected one by one, from one row to the other, through a recess in the cylinder head, so as to form a pair of cylinders in communication with each other, permitting gases to flow from one cylinder to the other, irrespective of the position of the piston in each of the cylinders.

According to the invention, in the case of an engine provided with compression ignition means, the engine comprises at least one fuel injector in the clearance space, the fuel being injected in mesh, at half speed, with the long-stroke crankshaft.

According to the invention, in the case of an engine provided with spark ignition means, the engine comprises at least one spark plug in the clearance space, the ignition being achieved through means known in the art, in synchronism, at half speed, with the long-stroke crankshaft.

According to the invention, engine timing is achieved through at least one camshaft in mesh, at half speed, with the long-stroke crankshaft, so as to connect periodically the pair of cylinders with the intake and exhaust pipes via the intake and exhaust valves, at definite moments of the four-stroke cycle. The expansion phase is effected simultaneously on each piston of the paired cylinders, so as to cause the two crankshafts to cooperate to the motive force. The long-stroke crankshaft is connected directly to the outer transmission line of the engine, so that the variably timed transmission only conveys the engine torque of the short-stroke crankshaft to the long-stroke crankshaft; the motive force on the variably timed transmission is thus dependent on the smaller cylinder of the paired cylinders.

The different lead angles effected by the variably timed transmission between the two crankshafts, alter at the end of the compression phase (top dead center of the piston in the smaller cylinder) an additional volume in the smaller cylinder. This additional volume is defined with the clearance space, so as to alter the compression ratio of the engine towards a maximum at the start-of-travel of the variably timed transmission and towards a minimum at the end-of-travel of the variably timed transmission.

According to the invention, a hydraulic force amplifier having a controlled thrustor acting on the variably timed transmission, alters the additional volume of the smaller cylinder in proportion to the supercharging pressure, so as to maintain the engine under optimal running conditions with a minimum of pollution.

Also according to the invention, a programme pre-established on a prototype engine permits the elimination of excessive pressure and temperature stresses. Each running condition of the engine is stored in a point-progression scale, so as to encompass all the engine output capabilities. Each point is a combination of values measured by four sensors : the intake air pressure, the intake air temperature, the engine speed and the engine temperature. Each combination is recorded simultaneously with the position of the thrustor actuating the variably timed transmission. This programme permits the automatic control of the standard type engine in the same way as that of the prototype engine. The fuel quality specifications should also be identical, so that the same running conditions are reproduced exactly on the standard type engine, by means of a high frequency monitoring of the values measured by the four sensors.

BRIEF DESCRIPTION OF THE DRAWING

The invention will be more fully understood from the following description, taken together with the accompanying drawings, as an example only and a non restrictive embodiment of the invention.

In the drawings:

FIG. 1 also shows helical splines mated between the first and third concentric members, having circular helixes contrary to those of the helical splines mated between the second and third concentric members;

DESCRIPTION OF THE PREFERRED EMBODIMENTS

Figure 1:
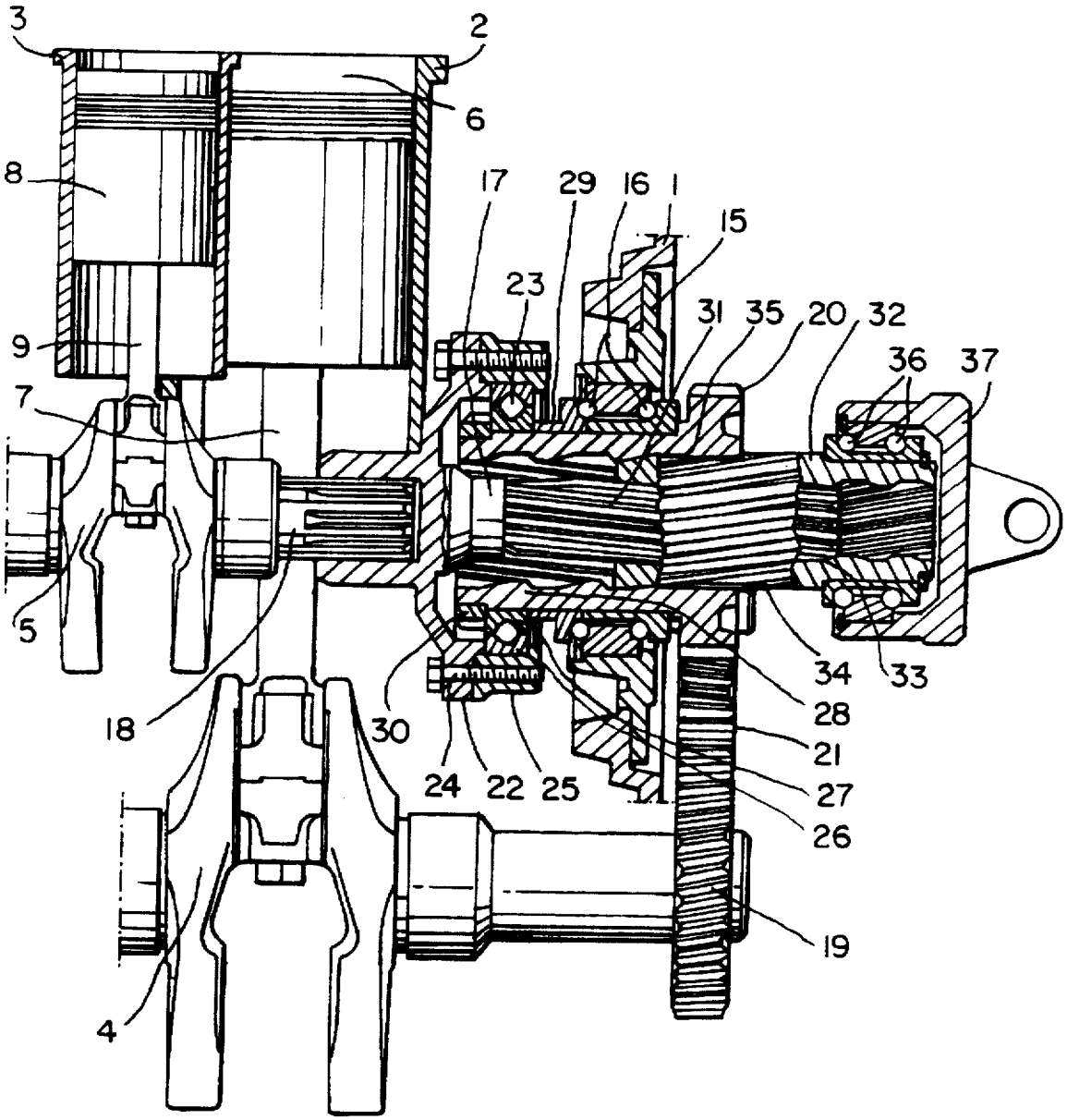
FIG. 1 is a partial longitudinal sectional view of a four-stroke engine having a variable volume combustion chamber with a ratio of 5 between the paired cylinders, shown in the start-of-travel position of the variably timed transmission, at the end of the compression phase.
Figure 2:
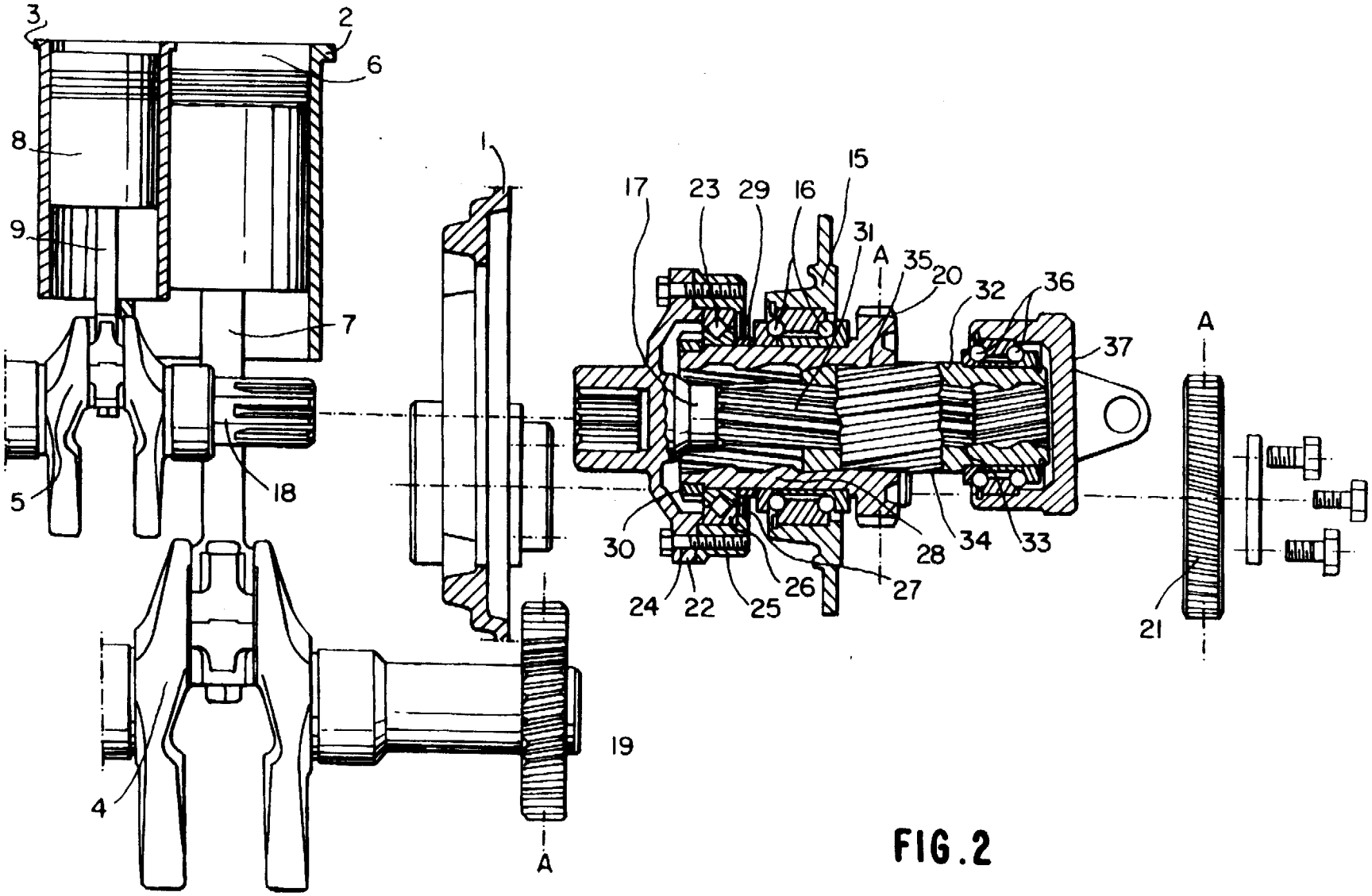
FIG. 2 is an exploded view of the engine according to FIG. 1, showing the variably timed transmission removed from the two crankshafts.
Figure 3:
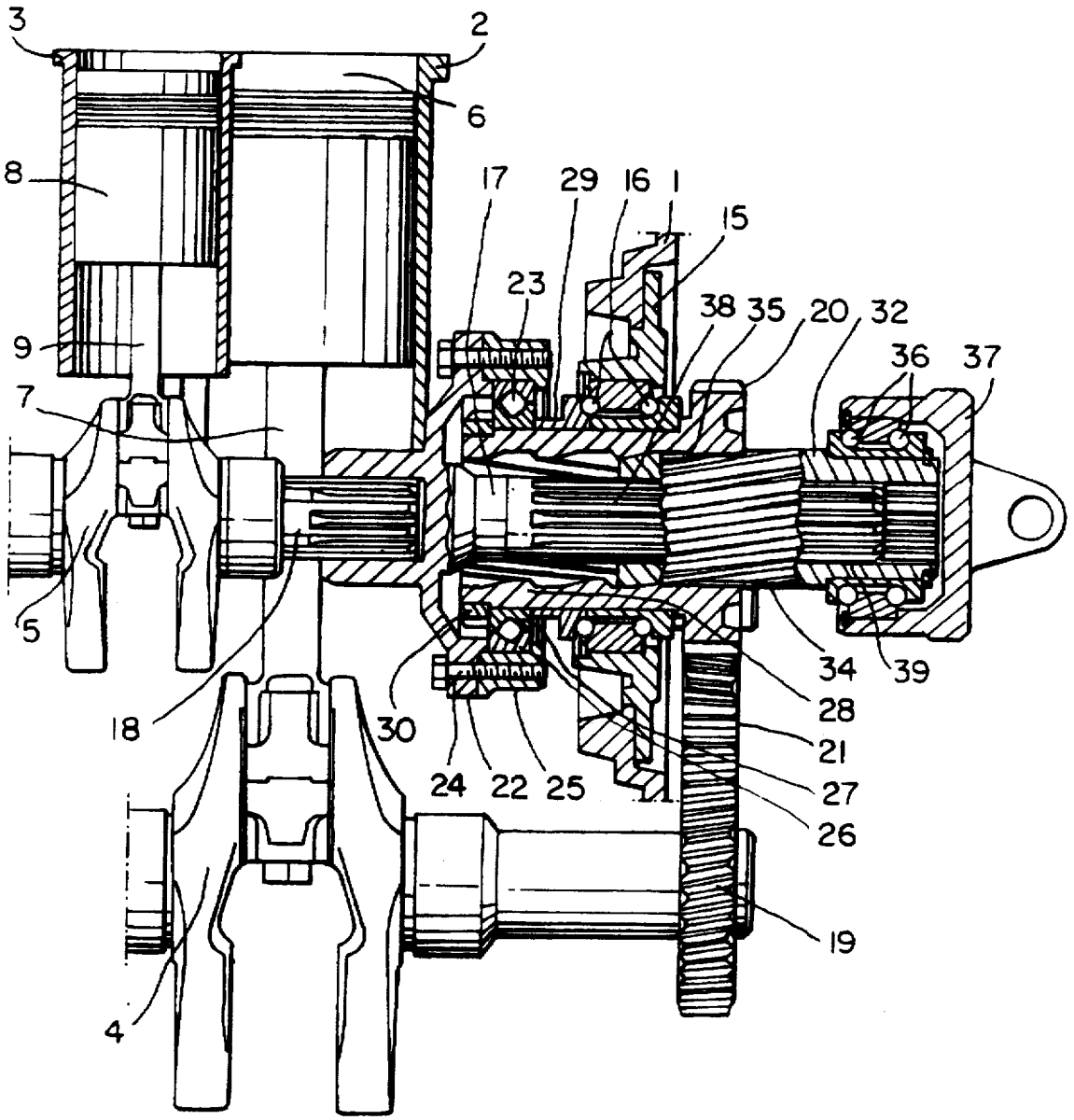
FIG. 3 represents the engine shown in figure, according to an alternative embodiment of the invention, and shows in detail straight splines mated between the first and third concentric members and helical splines mated between the second and third concentric members.
Figure 4:
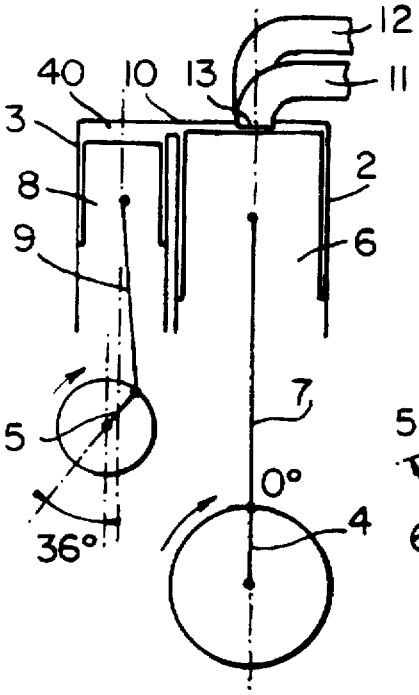
FIG. 4 is a schematic cross-sectional view of a four-stroke engine according to the invention, having a variable volume combustion chamber with a ratio of 5 between the paired cylinders, shown at the end of the compression phase, in the start-of-travel position of the variably timed transmission, with a 36° lead angle between the crank of the short-stroke crankshaft and the crank of the long-stroke crankshaft.
Figure 5:
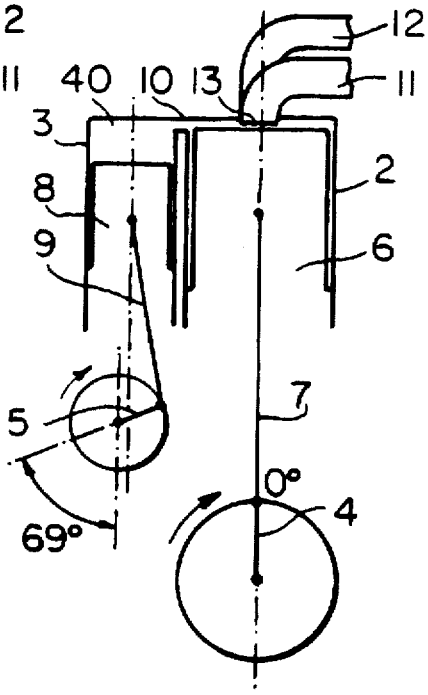
FIG. 5 is a schematic cross-sectional view of the same engine as in FIG. 4, shown at the end of the compression phase, in the end-of-travel position of the variably timed transmission, with a 69° lead angle between the crank of the short-stroke crankshaft and the crank of the long-stroke crankshaft.
Figure 6:
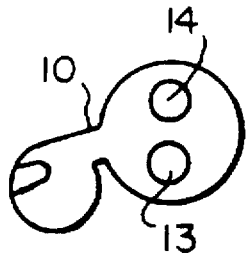
FIG. 6 is a plan view of the cylinder head bottom of the paired cylinders of the same engine as shown in FIGS. 4 and 5.
Figure 7:
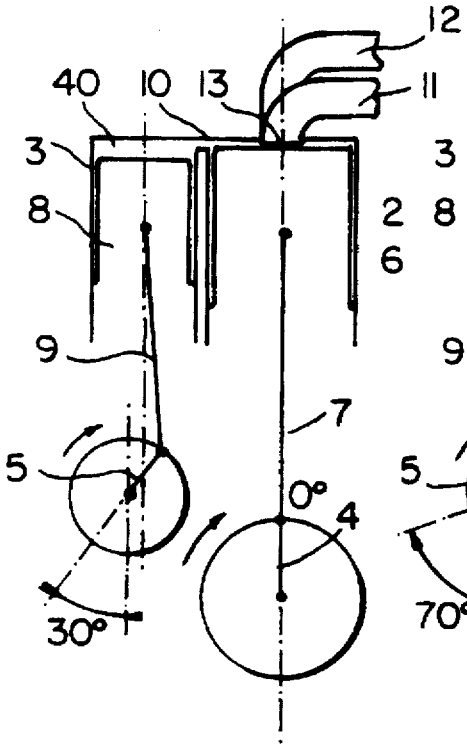
FIG. 7 is a schematic cross-sectional view of a four-stroke engine according to the invention, having a variable volume combustion chamber with a ratio of 2.5 between the paired cylinders, shown at the end of the compression phase, in the start-of-travel position of the variably timed transmission, with a 30° lead angle between the crank of the short-stroke crankshaft and the crank of the long-stroke crankshaft.
Figure 8:
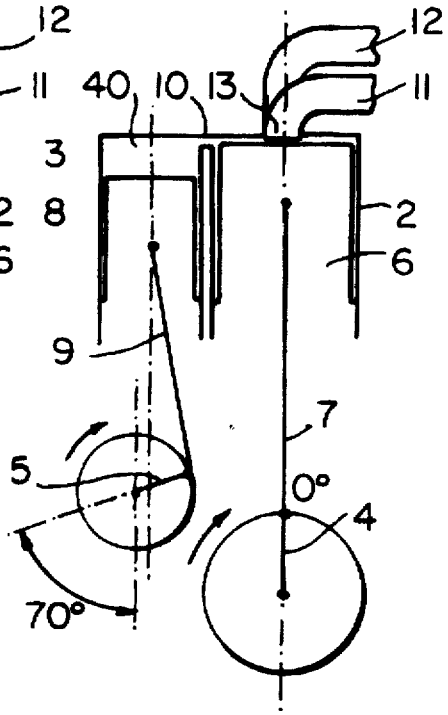
FIG. 8 is a schematic cross-sectional view of the same engine as in FIG. 7, shown at the end of the compression phase, in the end-of-travel position of the variably timed transmission, with a 70° lead angle between the crank of the short-stroke crankshaft and the crank of the long-stroke crankshaft.
Figure 9:
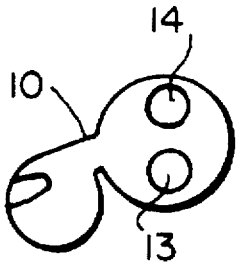
FIG. 9 is a plan view of the cylinder head bottom of the paired cylinders of the same engine as shown in FIGS. 7 and 8.

Referring to FIGS. 1 to 9, the crankcase (1) comprises two crankshafts (4 and 5) arranged parallel to one another, one with a long-stroke crank (4), the other with a short-stroke crank (5); the two cylinders (2 and 3), provided respectively with pistons (6 and 8) and connecting rods (7 and 9), are respectively arranged above one of the two crankshafts (4 and 5). The crank of the short-stroke crankshaft (5) coacts with the connecting rod (9) of the piston (8) in the smaller cylinder (3) and the crank of long-stroke crankshaft (4) coacts with the connecting rod (7) of the piston (6) in the larger cylinder (2). The two cylinders (2 and 3) are connected one by one, from one row to the other, through a recess in the cylinder head (10), so as to form a pair of cylinders (2 and 3) in communication with each other.

In the case of an engine provided with compression ignition means, the engine comprises at least one fuel injector (not shown) in the clearance space. The fuel is injected through means known in the art (not shown) in mesh, at half speed, with the long-stroke crankshaft (4).

In the case of an engine provided with spark ignition means, the engine comprises at least one spark plug (not shown) in the clearance space. The ignition is achieved through means known in the art (not shown) in synchronism, at half speed, with the long-stroke crankshaft (4).

Engine timing is achieved by means of at least one camshaft (not shown) in mesh, at half speed, with the long-stroke crankshaft (4). The section of the cylinder head (10) overhanging the larger cylinder (2) comprises the intake and exhaust valves (13 and 14), which connect periodically the pair of cylinders (2 and 3) with the intake and exhaust pipes (11 and 12) at definite moments of the four-stroke process.

In the case of an engine with an extremely high displacement, a second camshaft (not shown) in mesh, at half speed, with the long-stroke crankshaft (4) may be arranged in the section of the cylinder head (10) overhanging the smaller cylinder (3), so as to provide a second periodic opening and closing of the intake and exhaust at the same time as the opening and closing of the intake and exhaust valves of the larger cylinder (2). The ratio between the paired cylinders (2 and 3) is at least between 2.5 and 5, so as to permit engine accommodation to supercharging pressure ratios ranging from 1 to 7.

The variably timed transmission comprises three superposed concentric members:the first member is the drive shaft (17) located in the inner section, the second member is the sleeve (28) of gear (20) located in the outer section and the third member is the sliding tube (32) located in the intermediate section between the two aforesaid members. Said sleeve (28) is held in a bearing plate (15) by means of a suitable double-row angular contact bearing (16) mounted between the bearing plate (15) and sleeve (28). Said bearing plate (15) is secured to the engine unit (1) so that the variably timed transmission forms a separate assembly with respect to the shaft (18) of the short-stroke crankshaft (5). For this purpose, the variably timed transmission and the short-stroke crankshaft (5) are designed each with their own shaft (17 and 18). The abuting ends of shaft (17) of the variably timed transmission and of shaft (18) of the short-stroke crankshaft (5) are provided with straight male splines and corresponding female splines, so as to permit their coupling within the engine unit (1) through an axial slide movement when the bearing plate (15) is engaged in an opening of the engine unit (1). The bearing plate (15) is centred with respect to shaft (18) of the short-stroke crankshaft (5), so as to permit self-centering of shaft (17) with respect to shaft (18), the latter also acting as a free bearing for shaft (17) when the bearing plate (15) is applied against the engine unit (1); such means permits the variably timed transmission to be removed from the engine unit (1) without having to remove the short-stroke crankshaft (5).

Drive shaft (17) and sleeve (28) are advantageously held concentrically and axially with respect to each other by means of a bearing housing (22) rigidly connected to shaft (17). The bearing housing (22) is provided with an axial and radial thrust bearing (23), so as to permit free rotation of shaft (7) independently of sleeve (28). The bearing housing (22) is an integral part of shaft (17) at the boundary of the straight splines of the abuting ends which serve to couple shaft (17) to shaft (18) of the short-stroke crankshaft (5). The bearing housing (22) and sleeve (28) are located inside the engine unit (1). The bearing housing (22) is shaped as a disk which also serves as a flywheel. The periphery of said flywheel is regularly pierced with holes (24), so as to permit a ring (25) to be bolted onto the surface of the flywheel opposite the side where the boundary of the straight splines is located. The mounting of ring (25) on the flywheel of the bearing housing (22) serves to form a recess, so as to permit the mounting of the outer ring (26) of the axial and radial thrust bearing (23). The inner ring (27) of bearing (23) is mounted on the sleeve (28) against a ring-shaped spacer (29) encircling sleeve (28). The spacer (29) serves to take up the space between the inner ring (27) of bearing (23) and the inner ring of the angular contact bearing (16), the latter being held axially against a shoulder of sleeve (28) through the securing of all above parts, by means of a single nut (30) on sleeve (28).

Gear (20) of sleeve (28) is located outside the engine unit (1) and is coupled, at the same rotational speed, to the long-stroke crankshaft (4) by means of a gear (19) rigidly mounted on the latter and an intermediate gear (21) located between both aforesaid gears (19 and 20).

The drive shaft (17) comprises, on the side of the bearing housing (22) facing the bearing plate (15), helical splines (31) onto which the sliding tube (32) is engaged. The inner surface of said sliding tube (32) comprises splines (33) mated to the helical splines (31), so as to permit the sliding tube (32) to travel helically along drive shaft (17) and provide an angular displacement between said first and third members.

The outer surface of the sliding tube (32) also comprises helical splines (34), the helix of which is contrary to that of the splines (33) on the inner surface of the sliding tube (32). The inner surface of sleeve (28) comprises helical splines (35) mated to the outer helical splines (34) of the sliding tube (32), so as to permit the latter to travel helically in sleeve (28) and provide an angular displacement between said second and third members, at the same time as the helical travel of the sliding tube (32) along drive shaft (17). The sleeve (28) rotates again with shaft (17) when the sliding tube (32) no longer travels axially.

The length of the sliding tube (32) is established inside sleeve (28) when the end of said sliding tube (32) is located at the stop point defined by the surface of the bearing housing (22), the other end of the sliding tube (32) is free outside sleeve (28), passes through gear (20) and emerges from the engine unit (1), so as to permit, through appropriate means, the inner ring of the double-row angular contact bearing (36) to be mounted and secured. Said inner ring of bearing (36) rotates with the sliding tube (32), whereas the outer ring of bearing (36) does not rotate and is rigidly connected to the holding member (37).

A decision-making memory of the compression ratio programme, acting by means of a hydraulic control system, permits the holding member (37) and the sliding tube (32) to be shifted, so as to alter the lead angle between the two crankshafts (4 and 5).

The start-of-travel of the variably timed transmission is arranged so that the sliding tube (32) is at the travel-out stop position (not shown) of sleeve (28) (low torque), which corresponds to the minimum lead angle between the crank of the short-stroke crankshaft (5) and the crank of the long-stroke crankshaft (4).

The end-of-travel of the variably timed transmission is arranged so that the sliding tube (32) is at the travel-in stop position (not shown) of sleeve (28) (high torque), which corresponds to the maximum lead angle between the crank of the short-stroke crankshaft (5) and the crank of the long-stroke crankshaft (4).

According to the invention, to define and facilitate the coupling of both crankshafts (4 and 5) between the variably timed transmission, the number of teeth of gear (20) is even when the number of mated splines (34 and 35) of sliding tube (32) and sleeve (28) respectively, of mated splines (31 and 33) of shaft (17) and sliding tube (32) respectively, and of abuting splines between both shafts (17 and 18) is uneven and vice versa.

According to an alternative embodiment of the invention, the shaft (17) of the variably timed transmission comprises, on the side of the bearing housing (22) facing the bearing plate (15), straight splines (38) instead of helical splines (31), onto which the sliding tube (32) is engaged, and the inner surface of the sliding tube (32) comprises straight splines (39) instead of helical splines (33), mated to the straight splines (38) of shaft (17).

According to the invention, the minimum and maximum compression ratios selected for the type of engine to be designed, are determined based on the dimensions of the different engine members, i.e. on the one hand, the ratio between the displacements of the paired cylinders (2 and 3) and, on the other hand, the ratio between the total displacement of these cylinders (2 and 3) and the clearance space (40), these ratios being defined so that the maximum lead angle between the crank of the short-stroke crankshaft (5) and the crank of the long-stroke crankshaft (4), defined by the end-of-travel position of the variably timed transmission, determines at the end of the compression phase (top dead center of piston 6), the position of piston (8) with respect to the additional volume required for the clearance space (40) to define said minimum compression ratio of the engine, with an angle of at least 90° between the connecting rod (9) and the crank of the short-stroke crankshaft (5).

The adjustment of the angle between both crankshafts, in the end-of-travel position of the variably timed transmission, in function of the appropriate dimensions of the different engine members, allows the engine to operate:

- in the expansion phase, with the combustion gases on the piston (8) associated at least from the maximum instantaneous torque on the crank of the short-stroke crankshaft (5);
- in the expansion phase, by limiting the rise of piston (8) prior to the opening of the exhaust valve (14), a source of combustion gas back pressure on said piston (8);
- at the end of the intake phase, by limiting the rise of piston (8), a cause of loss of filling volume within the cylinder (3).

This offers the advantage of maintaining the maximum specific output of the engine at full load.

The maximum compression ratio selected is achieved with the same data basis of dimensional values defined for the minimum compression ratio, so that the minimum lead angle between the crank of the short-stroke crankshaft (5) and the crank of the long-stroke crankshaft (4), defined by the start-of-travel position of the variably timed transmission, determines at the end of the compression phase (top dead center of piston 6), the position of piston (8) with respect to the additional volume required for the clearance space (40) to define said maximum compression ratio of the engine, with the connecting rod (9) of the crank of the short-stroke crankshaft (5) away from its top dead center, so that said connecting rod (9) forms an angle with the crank of the short-stroke crankshaft (5).

The adjustment of the angle between both crankshafts, in the start-of-travel position of the variably timed transmission, in function of the appropriate dimensions of the different engine members, allows the engine to operate:

at the end of the compression phase, by providing a greater translational motion to piston (8) per unit degree of angular displacement between the cranks of the two crankshafts (4 and 5).

This offers the advantage of speeding up the modification process of the compression ratio of the engine at low load.

Explanation of symbols used:

| | |
|---|---|
| P = | compression ratio. |
| V1 = | displacement of the larger cylinder of the paired cylinders. |
| V2 = | displacement of the smaller cylinder of the paired cylinders. |
| $v_1/v_2$ = | ratio between the displacements of the paired cylinders. |
| α = | lead angle of the crank of the short-stroke crankshaft. |
| ve = | clearance space of the paired cylinders required for gas transfer without excessive lamination. |
| (α minimum) = | lead angle of the crank of the short-stroke crankshaft, at the start-of-travel of the variably timed transmission. |
| (α maximum) = | lead angle of the crank of the short-stroke crankshaft, at the end-of-travel of the variably timed transmission. |
| Va (α minimum) = | additional volume added to the clearance space, at the start-of-travel of the variably timed transmission, defined by the minimum lead angle of the crank of the short-stroke crankshaft, when the crank of the long-stroke crankshaft is located at its top dead center, at the end of the compression phase. |
| Va (α maximum) = | additional volume added to the clearance at the end-of-travel of the variably timed transmission, defined by the maximum lead angle of the crank of the short-stroke crankshaft, when the crank of the long-stroke crankshaft is located at its top dead center, at the end of the compression phase. |
| Vr (α minimum) = | compressed air volume at the start-of-travel of the variably timed transmission, defined by the minimum lead angle of the crank of the short-stroke crankshaft, when the crank of the long-stroke crankshaft is located at its bottom dead center, at the end of the intake phase. |
| Vr (α maximum) = | compressed air volume at the end-of-travel of the variably timed transmission, defined by the maximum lead angle of the crank of the short-stroke crankshaft, when the crank of the long-stroke crankshaft is located at its bottom dead center, at the end of the intake phase. |

Compression ratio characteristics and formulas of the variable volume combustion chamber engine.

$$(Vb+V2)\times\text{number of pairs of cylinders}=\text{engine displacement.}$$

$$V1+[V2-Vr(\alpha)]\times\text{number of pairs of cylinders}=\text{displacement of the engine defined by the lead angle of the variably timed transmission.}$$

$$\frac{V1+[V2-Vr(\alpha)]+ve}{ve+Va(\alpha)}=P\text{ theoretic}$$

theoretic compression characteristic of the engine after definition of the compression ratios established by the lead angle of the variably timed transmission.

$$\frac{V1+[V2-Vr(\alpha\text{ minimum})]+ve}{ve+Va(\alpha\text{ minimum})}=P\text{ maximum}$$

definition of the maximum compression ratio at the start-of-travel of the variably timed transmission. In practice, Vr (α minimum) should not be deducted from V2 as it is too negligible.

$$\frac{V1+[V2-Vr(\alpha\text{ maximum})]+ve}{ve+Va(\alpha\text{ maximum})}=P\text{ minimum}$$

definition of the minimum compression ratio at the end-of-travel of the variably timed transmission. In practice, Vr (α maximum) should not be deducted from V2 since the air mass admitted in V1 and V2 depends on the stored calibration at the maximum supercharging pressure.

A simplified formula of the compression ratio may be assumed depending on whether Va (α) is located at any angular position between the start-of-travel and the end-of-travel of the variably timed transmission, which is:

$$\frac{V1+V2+ve}{ve+Va(\alpha)}=P$$

According to the invention, the minimum compression ratio selected may be achieved between two end-of-travel limits of the variably timed transmission. The first limit is achieved with a maximum lead angle between the crank of the short-stroke crankshaft (5) and the crank of the long-stroke crankshaft (4), so as to determine at the end of the compression phase (top dead centre of piston 6) the position of piston (8) with respect to the additional volume required for the clearance space (40) to define said minimum compression ratio with an angle of at least 90° between the connecting rod and the crank of the short-stroke crankshaft (5), the second limit is achieved with a smaller lead angle between the crank of the short-stroke crankshaft (5) and the crank of the long-stroke crankshaft (4), proportionally to the reduction of the displacement ratio of the two cylinders (2 and 3), up to the tolerance limit generated by the working area of the two crankshafts (4 and 5), defined by the parallel and close positions of the paired cylinders (2 and 3), according to the following minimum compression ratio formula:

$$\frac{V1+[V2-Vr(\alpha\text{ maximum})]+ve}{Ve+Va(\alpha\text{ maximum})}=P\text{ minimum}$$

It is possible to define a higher compression ratio between the displacements of the paired cylinders, so as to reduce the stresses on the variably timed transmission mounted on engines having lower displacements and inversely, it is possible to define a smaller compression ratio between the displacements of the paired cylinders (2 and 3), so as to increase the speed of engines having higher displacements.

In practice, Vr (α maximum) should not be deducted from V2, since the mass of air admitted in V1 and V2 depends on the stored calibration between the compression ratio and the supercharging pressure.

The maximum compression ratio selected is achieved on the basis of the dimensional values defined for the minimum compression ratio, so that at the start-of-travel of the variably timed transmission, the minimum lead angle between the crank of the short-stroke crankshaft (5) and the crank of the long-stroke crankshaft (4) determines, at the end of the compression phase (top dead centre of piston 6), the position of piston (8) with respect to the additional volume required for the clearance space (10) to define a maximum compression ratio, with the connecting rod (9) of the crank of the short-stroke crankshaft (5) away from its top dead centre, so that said connecting rod (9) forms an angle with the crank of the short-stroke crankshaft (5). The maximum compression ratio may thus be defined by means of the following formula:

$$\frac{V1 + [V2 - Vr(\alpha\ \text{minimum})] + ve}{ve + Va(\alpha\ \text{minimum})} = P\ \text{maximum}$$

In practice, Vr (α minimum) should not be deducted from V2, since the mass of air admitted in V1 and V2 depends on the stored calibration between the compression ratio and the atmospheric depression in the intake pipe.

Figure 10:
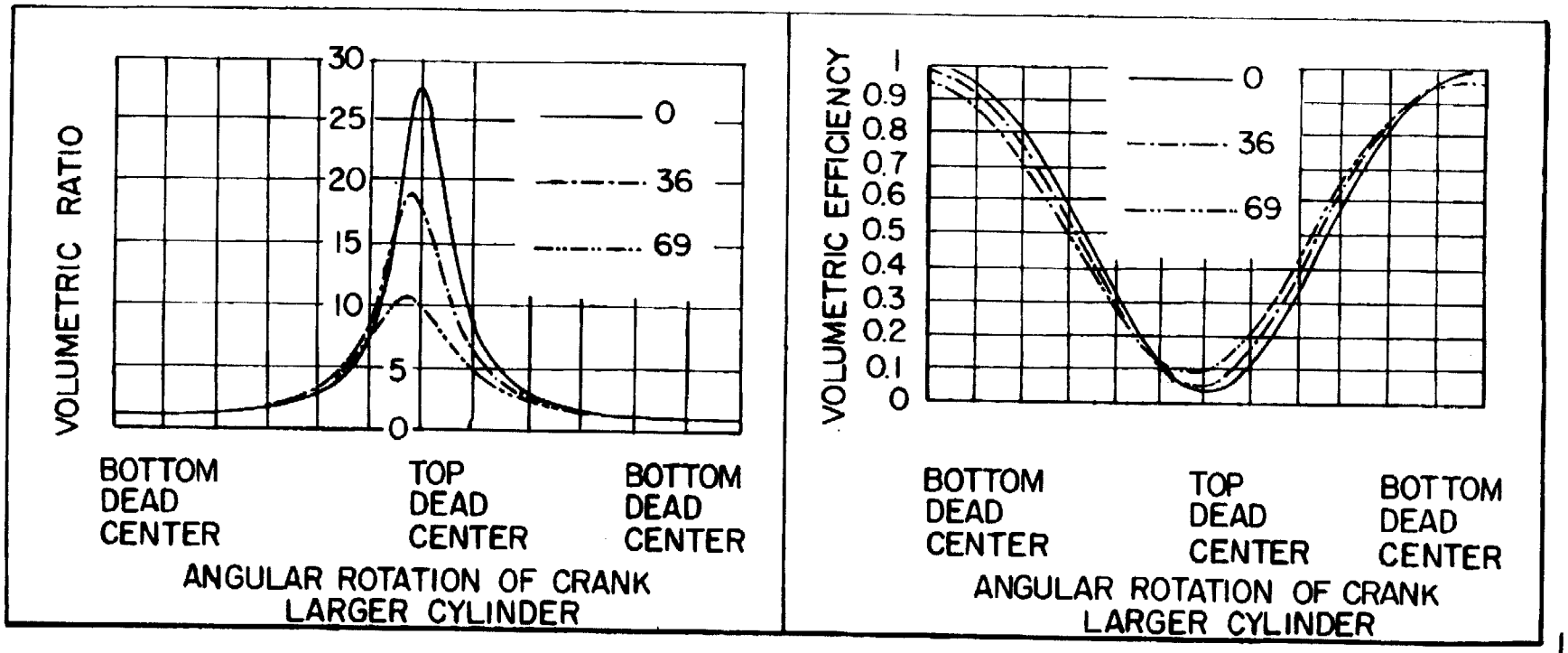
FIG. 10 shows the superposed diagrams of an engine with a ratio of 5 between the displacements of the paired cylinders; said diagrams showing the compression ratios per degree of angular rotation of the long-stroke crankshaft (5) in the compression and expansion phases without ignition, in the start-of-travel and end-of-travel positions of the variably timed transmission, with the corresponding volumetric efficiencies.
Figure 11:
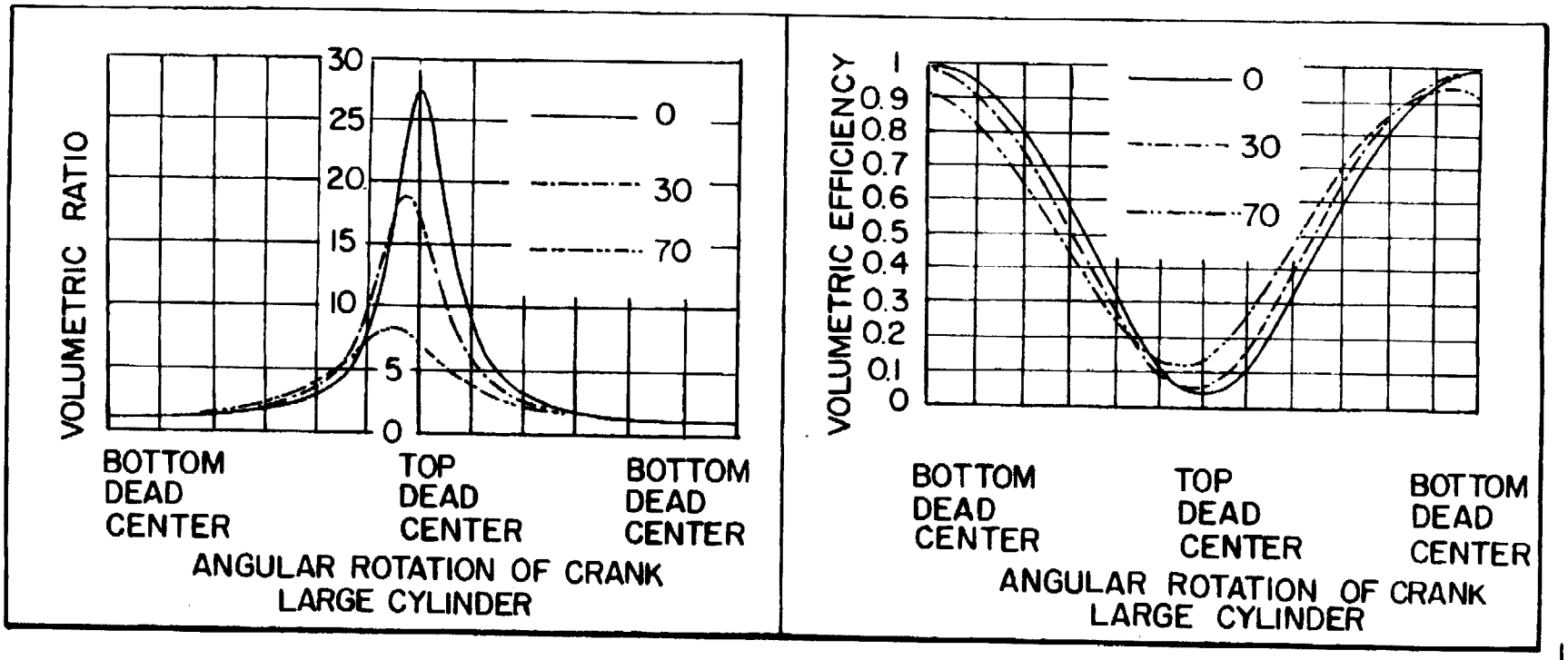
FIG. 11 shows the superposed diagrams of an engine with a ratio of 2.5 between the displacements of the paired cylinders; said diagrams showing the compression ratios per degree of angular rotation of the long-stroke crankshaft (5) in the compression and expansion phases without ignition, in the start-of-travel and end-of-travel positions of the variably timed transmission, with the corresponding volumetric efficiencies.

The diagrams of FIGS. 10 and 11 are based on the following formula:

a = top dead center of smaller cylinder
b = summit of smaller piston
s = surface of smaller piston
l = length of smaller connecting rod
r = length of smaller crankshaft
A = top dead center of larger cylinder
B = summit of larger piston
S = surface of larger piston
L = length of larger connecting rod
R = length of larger crankshaft
Vm = clearance space
α = angular rotation (o°at top dead center) (counterclockwise)
ϕ = lead angle of smaller crankshaft with respect to the larger crankshaft $$V = ab \times s + AB \times S + Vm = s[r(1 - \cos(\alpha + \phi)) + l(1 - \sqrt{1-(r/l)^2\sin^2(\alpha\phi)}\ )] + S[R(1 - \cos\alpha) + L(1 - \sqrt{1-(R/L)^2\sin^2\alpha}\ )] + Vm$$

Example to make the engine functional and performant according to one of the numerous applications.

The above formula stored in a computer computation sheet allows generation and selection of the dimensional values of the different engine members, i.e. the compression ratios between the displacements of the paired cylinders (2 and 3) and the ratio between the total volume of these cylinders (2, 3) and the clearance space (40); the computation sheet is defined so that the values reckoned for the maximum and minimum compression ratios of the engine coincide with the corresponding degrees of the minimum and maximum lead angles between the crank of the short-stroke crankshaft and the crank of the long-stroke crankshaft, respectively at the start-of-travel and at the end-of-travel of the variably timed transmission. The diagrams of FIGS. 10 and 11 show examples of variation curves of the compression ratio and of the volumetric efficiency of the paired cylinders (2,3) over 360° of angular rotation of the crank of the long-stroke crankshaft (4).

According to a particular embodiment of the invention, in the case of a high-capacity power unit, the two crankshafts (4 and 5) are each mechanically connected to a generator and the electrical circuits of the two generators are connected in parallel. The capacity of each generator is defined in function of the actual output of the corresponding crankshaft at cruise speed of the engine, so that the variably timed transmission and the corresponding couplings of the two crankshafts (4 and 5) are limited to torque compensating loads.

Advantages for a four-stroke engine with compression ignition means.

higher volumetric efficiency;

higher specific output;

lower losses due to mechanical friction;

engine accommodation to the cetane number;

accurate definition of an ideal temperature at the end of the compression phase, so as to provide suitable self-ignition of the fuel in all circumstances (from cold starting to high supercharging pressures);

better engine performance at high altitudes;

lower emissions of hydrocarbons and nitrogen oxide in the exhaust gases.

Advantages for a four-stroke engine with spark ignition means.

higher volumetric efficiency;

higher specific output;

lower losses due to mechanical friction and pumping;

higher partial-load efficiency of the engine, due to a higher compression ratio proportionally to the depression in the intake pipe (closing of the throttle valve);

engine accomodation to the octane number;

better engine performance at high altitudes;

better air-fuel mixture homogeneity;

lower emmissions of carbon monoxide, nitrogen oxides and hydrocarbons in the exhaust gases.

Advantages and conditions of use of the four-stroke engine with compression ignition means and high supercharging pressure levels, mounted in road haulage tractors.

The reduction of the displacement of each cylinder of the engine, based on the mean piston speed, permits an increase in the speed of the engine and a consistent decrease in low frequencies. A higher gear reduction on the gearbox—output shaft assembly should however be provided up to the second engine-drive reduction. Since the mechanical friction is proportional to the displacement and less load-sensitive, the efficiency is higher. The engine brake may be kept whilst increasing the power of the engine, supported by a speed limiter on the vehicle.

What is claimed is:

1. A four-stroke internal combustion engine having an intake phase, a compression phase, an expansion phase and an exhaust phase, said engine including:

reciprocating pistons, said pistons being chosen among the group including pistons of self-ignition cylinders and the pistons of spark ignition cylinder;

two crankshafts, the first crankshaft having a long-stroke crank and the second crankshaft having a crank with a stroke shorter than that of the first crankshaft, said crankshafts being coupled at the same rotational speed via a gear train and a variably timed transmission;

a number of cylinders comprising a first set of larger cylinders arranged above the first crankshaft and a second set of smaller cylinders arranged above the second crankshaft, each of said smaller cylinders having a displacement smaller than that of each of said larger cylinders, each piston of a larger cylinder of the first set being connected to a crank of the first crankshaft by means of a connecting rod, said crank of the first crankshaft moving successively between a top dead center and a down dead center, while each piston of a smaller cylinder of the second set is connected to a crank of the second crankshaft by means of a connecting rod, said crank of the second crankshaft moving successively between a top dead center and a down dead center whereby, for each cylinder, a volume of a cylinder defined by a position of a piston therein varies between a clearance volume of said cylinder and a maximum volume of said cylinder, each larger cylinder of the first set communicating with one smaller cylinder of the second set via a clearance space, so as to form a plurality of groups, each group consisting of a larger cylinder and a smaller cylinder in communication with each other, so as to enable gases to flow from one cylinder in the group to another cylinder in the group, irrespective of the position of the piston in each of said cylinders, each crank of each crankshaft defining a rotation angle with respect to a vertical;

a camshaft in mesh, at half speed, with the first crankshaft, so as to connect periodically each group consisting of a larger cylinder and a smaller cylinder with intake and exhaust pipes via intake and exhaust valves, at definite moments of the four-stroke cycle, wherein the variably timed transmission has a control mechanism to vary for a group consisting of a larger cylinder and a smaller cylinder a lead angle between the rotation angle of the crank of the second crankshaft and the rotation range of the crank of the first crankshaft, by means of a hydraulic force amplifier having a controlled thruster acting on the transmission, said transmission altering at the end of the compression phase of the piston in the larger cylinder, the compression ratio of the engine between a minimum and a maximum, said minimum and maximum compression ratios depending on:

1) the ratio between the displacement of the larger cylinder and the displacement of the smaller cylinder, and 2) the ratio between (a) the total volume of the smaller cylinder and the larger cylinder and between (b) the volume of the minimum clearance space above the cylinders and an additional volume created in the smaller cylinder at the end of the compression phase of the piston in the larger cylinder, the variably timed transmission adjusting the lead angle between the rotation angle of the crank for the second crankshaft and the rotation angle of the crank of the first crankshaft, so as to obtain said compression ratios, said lead angle varying between a maximum corresponding to an angle for which an angle of at least 90° exists between the connecting rod of the piston of the smaller cylinder and the crank of the second crankshaft on which said connecting rod is connected, at the end of the compression phase of the piston in the larger cylinder, in order to define a volume of the smaller cylinder equal to the sum of its clearance volume and a first additional volume and corresponding to the minimum compression ratio at the end of the compression phase of the piston in the larger cylinder, and a minimum so that the lead angle corresponds, at the end of the compression phase of the piston in the larger cylinder, to the appropriate position of the piston in the smaller cylinder to define a volume equal to the sum of its clearance volume and another additional volume, said other additional volume being smaller than the said first additional volume corresponding to the minimum compression ratio, said other additional volume being the additional volume required to obtain the maximum compression ratio, while the crank of the second crankshaft is still forming an angle with the connecting rod of the piston in the smaller cylinder greater than the angle between the crank of the second crankshaft and the connecting rod corresponding to the maximum lead angle.

2. A four-stroke internal combustion engine according to claim 1, wherein the cylinders of said at least one group are chosen so that the ratio between the displacement of the larger cylinder and the displacement of the smaller cylinder is reduced to the tolerance limit defined by the working area of the two crankshafts defined by their parallel nd close positions with respect to the two cylinders, so as to reduce the lead angle of the crank of the second crankshaft in order to obtain the minimum compression ration at the end-of-travel for the variably time transmission, the reduction of the lead angle being proportional to the reduction of the ratio between the displacement of the larger cylinder and the displacement of the smaller cylinder.

3. A four-stroke combustion engine according to claim 1, wherein the variably time transmission includes three superposed concentric members, i.e., an inner member constituted by a drive shaft, an outer member constituted by a sleeve supporting a gear for coupling the two crankshafts, and an intermediate member located between said inner and outer remembers and constituted by a tube which slides with respect to said inner and outer members, the sleeve being held in a bearing plate by means of a double-row angular contact bearing, wherein the shaft of the second crankshaft has one end which abuts one end of the drive shaft, said ends having straight male splines and corresponding female splines, so as to enable coupling and self-centering of the three members with respect to the shaft of the second crankshaft when the bearing plate is engaged in an opening of the engine unit, and enable the transmission to be removed without having to remove the second crankshaft, wherein a bearing has a mounting ring which forms the housing of the outer ring of a bearing, the inner ring of which is mounted on the sleeve so as to hold the drive shaft, wherein a spacer extends between the inner ring of the bearing and inner ring of the angular contact bearing, said spacer serving to take up the space between said rings and holding axially the ring of the angular contact bearing against a shoulder of the sleeve, wherein a single nut holds the inner rings of the bearing and of the angular contact bearing and the spacer on the Sleeve, wherein the drive shaft has, on the side of the mounting ring, helical or straight splines onto which the sliding tube is engaged, the inner surface of which has helical or straight splines so as to enable said tube to travel helically or linearly along the drive shaft, wherein the inner surface of the sleeve has helical splines, the helix of which is contrary to that of the splines of the drive shaft when the latter are helical, wherein the sliding tube has an end permanently free outside the sleeve, said end being held by an inner ring of a double-row angular contact bearing, the outer ring of said bearing being rigidly connected to a holding member of the thrustor, and wherein the helical salines are arranged so that when the sliding tube travels out of the sleeve, said tube reduces the lead angle between the crank of the second crankshaft and the crank of the first crankshaft.

4. A four-stroke internal combustion engine according to claim 3, wherein the gear supported by the sleeve has an even number of teeth when the number of teeth of the splines between the drive shaft and the sliding tube and the number of teeth of the splines at the abutting ends of the drive shaft and of the shaft of the second crankshaft are uneven.

5. A four-stroke internal combustion engine according to claim 3, wherein the gear supported by the sleeve has an even number of teeth when the number of teeth of the splines between the drive shaft and the sliding tube and the number of teeth of the splines at the abutting ends of the drive shaft and of the shaft of the second crankshaft are even.

6. A four-stroke internal combustion engine according to claim 1, wherein the spark ignition means includes at least one spark plug in the clearance space, the ignition being effected in synchronism, at half speed, with the first crankshaft.

7. A four-stroke internal combustion engine according to claim 1, wherein the ratio between the displacement of the larger cylinder of a group consisting of a larger cylinder and a smaller cylinder and the displacement of the smaller cylinder of said group is between 2.5 and 5.

8. A four-stroke internal combustion engine according to claim 1, in which the timed transmission has an element actuated by the control mechanism for moving it at the end of the compression phase of the piston in the larger cylinder a distance between a start of travel and an end of travel, the said minimum compression ratio at the end of the compression phase of the piston in the larger cylinder corresponding to the end of travel of the element, said minimum compression ratio being calculated by the following formula:

$$\frac{V1 + [V2 - Vr(\alpha \text{ maximum})] + ve}{Ve + Va(\alpha \text{ maximum})} = P \text{ minimum}$$

in which

V1 is the displacement of the larger cylinder;

V2 is the displacement of the smaller cylinder;

Ve is the clearance space enabling the passage of gases between the larger cylinder and the smaller cylinder;

α maximum is the maximum angle of at least 90° between the connecting rod of the piston of the smaller cylinder and the crank of the second crankshaft, at the end of travel;

Vr (α maximum) is the volume of the group comprised of a larger cylinder and a smaller cylinder at the end of travel, and Va (α maximum) is the volume of the group comprised of a larger cylinder and a smaller cylinder at the start of travel.

* * * * *

UNITED STATES PATENT AND TRADEMARK OFFICE

CERTIFICATE OF CORRECTION

PATENT NO. : 5,638,777
DATED : June 17, 1997
INVENTOR(S) : Gilbert L. VAN AVERMAETE It is certified that error appears in the above-indentified patent and that said Letters Patent is hereby corrected as shown below:

Column 3, line 7, after "figure" insert --1--.

Column 7, line 45, after "clearance" insert --space--;

line 67, change "(Vb+V2)" to --(V1+V2)--.

Column 8, line 57, change "Ve + Va($\alpha$ maximum)" to --$\nu$e + Va($\alpha$ maximum)--.

Column 9, line 45, change "1(1- 1-(r/1)$^2$sin$^2$($\alpha\phi$) )] + S[R(1 - cos$\alpha$)+" to -- 1(1- 1-(r/1)$^2$sin$^2$($\alpha+\phi$) )] + S[R(1 - cos$\alpha$)+ --.

Column 12, line 18, change "nd" to --and--;
line 21, change "ration" to --ratio--.

Column 14, line 12, change "Ve + Va($\alpha$ maximum)" to --$\nu$e + Va($\alpha$ maximum)--;
line 17, change "Ve" to --$\nu$e--.

Signed and Sealed this

Seventh Day of October, 1997

*Attest:*

Bruce Lehman

BRUCE LEHMAN

*Attesting Officer*

*Commissioner of Patents and Trademarks*